US008683841B1

(12) United States Patent
Walsh

(10) Patent No.: US 8,683,841 B1
(45) Date of Patent: Apr. 1, 2014

(54) APPARATUS AND METHOD TO CUT HVAC ROUND AND SPIRAL DUCTWORK AND ALL ATTACHING STRUCTURES

(75) Inventor: Matthew J. Walsh, Bohemia, NY (US)

(73) Assignee: Walsh Atkinson Co., Inc., Bohemia, NY (US)

( * ) Notice: Subject to any disclaimer, the term of this patent is extended or adjusted under 35 U.S.C. 154(b) by 901 days.

(21) Appl. No.: 12/686,770

(22) Filed: Jan. 13, 2010

Related U.S. Application Data

(60) Provisional application No. 61/145,801, filed on Jan. 20, 2009.

(51) Int. Cl.
*B21F 3/02* (2006.01)

(52) U.S. Cl.
USPC ..... 72/324; 219/121.36; 219/121.54; 72/325; 72/326; 72/327

(58) Field of Classification Search
USPC ..... 72/325–329; 219/121.39
See application file for complete search history.

(56) References Cited

U.S. PATENT DOCUMENTS

| | | | | |
|---|---|---|---|---|
| 1,654,160 | A * | 12/1927 | Coberly | 72/324 |
| 3,153,109 | A * | 10/1964 | Steventon et al. | 266/59 |
| 3,465,568 | A * | 9/1969 | Jonason | 72/338 |
| 3,850,086 | A * | 11/1974 | Walters et al. | 454/49 |
| 4,020,405 | A * | 4/1977 | Schumann et al. | 318/432 |
| 4,052,039 | A | 10/1977 | Koyano | |
| 4,165,667 | A * | 8/1979 | Brolund et al. | 83/409 |
| 4,216,945 | A * | 8/1980 | Krieg | 266/56 |
| 4,323,223 | A * | 4/1982 | Noll | 266/54 |
| 4,327,615 | A | 5/1982 | Gerber et al. | |
| 4,349,182 | A * | 9/1982 | Blackburn | 266/57 |
| 4,384,901 | A * | 5/1983 | Swoboda et al. | 148/195 |
| 4,417,363 | A * | 11/1983 | Lee, Jr. | 82/124 |
| 4,480,821 | A * | 11/1984 | Noll et al. | 266/54 |
| 4,483,721 | A * | 11/1984 | Hearn | 148/201 |
| 4,551,810 | A | 11/1985 | Levine | |
| 4,605,151 | A * | 8/1986 | Brown | 228/2.3 |
| 4,644,128 | A * | 2/1987 | Palentyn et al. | 219/121.67 |
| 4,864,239 | A * | 9/1989 | Casarcia et al. | 324/262 |
| 5,080,403 | A * | 1/1992 | Paoluccio | 285/229 |
| 5,117,668 | A * | 6/1992 | Philpot et al. | 72/135 |
| 5,740,341 | A * | 4/1998 | Oota et al. | 345/420 |
| 5,886,314 | A * | 3/1999 | Sims | 219/121.44 |
| 6,029,333 | A * | 2/2000 | Sapienza, IV | 29/407.01 |
| 6,218,639 | B1 * | 4/2001 | Bulle | 219/121.39 |
| 6,335,508 | B1 * | 1/2002 | Nam | 219/121.67 |
| 6,393,687 | B1 * | 5/2002 | Friedrich | 29/560 |
| 6,778,871 | B2 * | 8/2004 | Holman et al. | 700/98 |
| 6,886,251 | B1 | 5/2005 | Andrews | |
| 6,908,515 | B2 * | 6/2005 | Schroder et al. | 134/1 |
| 6,965,848 | B2 | 11/2005 | Ballus | |

(Continued)

FOREIGN PATENT DOCUMENTS

| | | | |
|---|---|---|---|
| CN | 1063434 | A | 8/1992 |
| JP | 6339771 | A | 12/1994 |
| JP | 2001277057 | A | 10/2001 |

*Primary Examiner* — Colleen Matthews
*Assistant Examiner* — William Harriston
(74) *Attorney, Agent, or Firm* — Wayne L. Lovercheck

(57) ABSTRACT

Apparatus and method for cutting HVAC round duct and spiral duct and all attendant-attaching structures comprising a computer controlled machine able to cut round and spiral HVAC ducts and also the ability to send attendant-attaching structures that are then cut on a flat X and Y cutting machine.

8 Claims, 11 Drawing Sheets

(56) References Cited

U.S. PATENT DOCUMENTS

| | | | | |
|---|---|---|---|---|
| 7,003,893 | B1 * | 2/2006 | Phuly | 33/529 |
| 7,073,366 | B2 * | 7/2006 | Hruschak et al. | 72/370.27 |
| 7,146,835 | B2 * | 12/2006 | Hruschak et al. | 72/7.1 |
| 7,251,902 | B1 * | 8/2007 | Mueller | 33/562 |
| 7,451,631 | B2 * | 11/2008 | Dickinson | 72/367.1 |
| 7,869,982 | B2 * | 1/2011 | Drumheller et al. | 703/1 |
| 2002/0139160 | A1 * | 10/2002 | Price et al. | 72/49 |
| 2003/0125826 | A1 | 7/2003 | Holman et al. | |
| 2004/0035169 | A1 * | 2/2004 | Slack | 72/78 |
| 2004/0200881 | A1 | 10/2004 | Gandy | |
| 2004/0231122 | A1 | 11/2004 | Sawyer et al. | |
| 2006/0225291 | A1 * | 10/2006 | Marks | 33/21.3 |
| 2006/0249001 | A1 * | 11/2006 | Egidi et al. | 83/508.2 |
| 2007/0204732 | A1 * | 9/2007 | Feinauer et al. | 82/117 |
| 2007/0276526 | A1 | 11/2007 | Swanson | |
| 2008/0000280 | A1 * | 1/2008 | Dickinson | 72/135 |
| 2010/0072746 | A1 * | 3/2010 | Jensen | 285/197 |
| 2010/0098965 | A1 * | 4/2010 | Mask et al. | 428/592 |
| 2010/0288010 | A1 * | 11/2010 | Suzuki | 72/379.2 |

* cited by examiner

60

61

62

APPARATUS AND METHOD TO CUT HVAC ROUND AND SPIRAL DUCTWORK AND ALL ATTACHING STRUCTURES

FIELD OF THE INVENTION

The present invention generally relates to round ductwork and spiral ductwork, and more specifically, to a system and method for cutting holes for attaching structures in round and spiral ductwork, and also mitering and cutting the ends of the round or spiral ducts, accurately while reducing time consuming labor.

BACKGROUND OF THE INVENTION

In general, round ducts are presently made by machines that form flat metal into a round duct. First the flat round duct material is passed though a roll-former that forms seams on the longitudinal length of the yet to be rolled round duct flat material. The flat round duct material is then typically rolled from the flat sheet that previously had seams applied to it into round duct in a rolling machine that can be either motorized or non-motorized, and manually or computer controlled. The seam is then manually interlocked to lock the seam closed thus creating a completed manufactured round duct.

Spiral ducts are presently formed from narrow 5 inch to 6 inch wide coil stock material of about 26 gauge to about 16 gauge thick, by a machine that is computer controlled, that automatically forms the diameter of the spiral duct while simultaneously creating seams to both edges of the coil stock material that then become interlocked in the machine thus creating spiral seamed round duct.

The attaching structures may be made by computer controlled flat X and Y plasma cutting machines. They are then manually formed and assembled.

After the attaching structures and the round or spiral ducts are manufactured, the cutouts for the must be cut into the round or spiral ducts.

Presently the cutouts are manually located on the round or spiral ducts by placing a template or the attaching structure to the round or spiral ducts and then manually tracing the shape of the needed cutout with a marker or pen.

Upon marking the round or spiral ducts the holes are then cut manually by using a scissors, jigsaw, or a hand held plasma torch.

It is very difficult and time consuming to measure and layout the cutouts into the round or spiral ducts accurately using this method.

Following are some examples of typical layouts:

First example: two cutouts at zero degrees of the longitudinal axis and 10 inches from the first end of the round or spiral ducts with the second cutout spaced at 40 inches from the first cut out on the round or round spiral ducts.

Second example: two cutouts one cutout at zero degrees and 10 inches from the first end of the round or spiral ducts with the second cutout at 180 degrees with the second cutout being measured and spaced at 40 inches from the first cutout.

Third example: three cutouts one cutout at zero degrees and 10 inches from the first end of the round or spiral ducts with the second cutout at 180 degrees with the second cutout being measured and spaced at 40 inches from the first cutout. Third cutout at 90 degrees being measured and spaced at 20 inches from the first cutout.

Fourth example: two cutouts one cutout at zero degrees and 10 inches from the first end of the round or spiral ducts with the second cutout at 180 degrees with the second cutout being measured and spaced at 40 inches from the first cutout and a miter cut of 30 degrees made to the second end of the round or round spiral duct.

The placing of the cutouts and trimming ends on round or spiral duct manually is labor intensive, time consuming, and can result in inaccuracies in many directions that often result in wasted materials and labor.

BRIEF SUMMARY OF THE INVENTION

In one embodiment, the method for cutting holes, rectangles, and irregular shapes onto round duct or spiral ducts is provided. The machine shall be referred to as the round duct and round spiral duct cutting machine.

The method includes entering a complete description of the completed finished duct with the attaching structures locations and sizes on the duct into a computer program, so that a list of product with instructions can be printed on labels or plain paper, while machine code language is then stored in the computer control of the round duct and round spiral duct cutting machine, and also the X and Y plasma cutting machine's computer control if applicable.

For example, a spiral duct with shoe tap, the main spiral duct could be cut at the round duct and round spiral duct cutting machine, while the shoe tap it self would be cut on the X and Y plasma-cutting machine.

Another common application could be a spiral duct with a tap hole in it, where the duct is made on a spiral pipe forming machine and the hole is then cut on the round duct and round spiral duct cutting machine while the tap-in pan is produced on the X and Y plasma cutting machine.

Using the instructions printed on the labels or plain paper that was printed from the computer program, the round or spiral duct is then manufactured or pulled from inventory. The label may have a job name, item name, and bar code printed upon it and is then applied to the round or spiral duct for identification purposes.

Meanwhile if applicable the attaching structures are pulled from inventory or manufactured at the computer controlled X and Y plasma cutting machine, which had previously received the machine code language that was created by the computer program.

The round or spiral duct is then loaded onto the bed of the round duct and round spiral duct cutting machine.

The round or spiral duct is then slid on the bed of the round duct and round spiral duct cutting machine so that the round or spiral duct is against the multiple jaw chuck. The multiple jaw chuck is then adjusted to grip the round or spiral duct so that the machine has full turning control of the round or round spiral duct.

The label is then used via a bar code scanner or by entering the job and item name into the round duct and round spiral duct cutting machine computer control to call up the appropriate machine code for the currently loaded round or spiral duct so it can then be cut.

The operator then gives a start command to the computer control of the round duct and round spiral duct cutting machine to cut holes, rectangles, and irregular shapes onto the round duct and round spiral duct.

The multiple jaw chuck and the linear motion carriage that carries the plasma cutting torch move simultaneously over the round or spiral duct using circular interpolation to cut holes, rectangles, and irregular shapes onto the round duct and round spiral duct.

A further understanding of the major advantages of the invention herein may be realized by reference to the remaining portions of the specification in the attached drawings.

BRIEF DESCRIPTION OF THE DRAWINGS

A more complete understanding of the present invention may be obtained from consideration of the following description in conjunction with the drawings in which.

DETAILED DESCRIPTION OF THE INVENTION

The round duct and round spiral duct cutting machine 10 has details seen in FIGS. 1 through 10.

Figure 6:
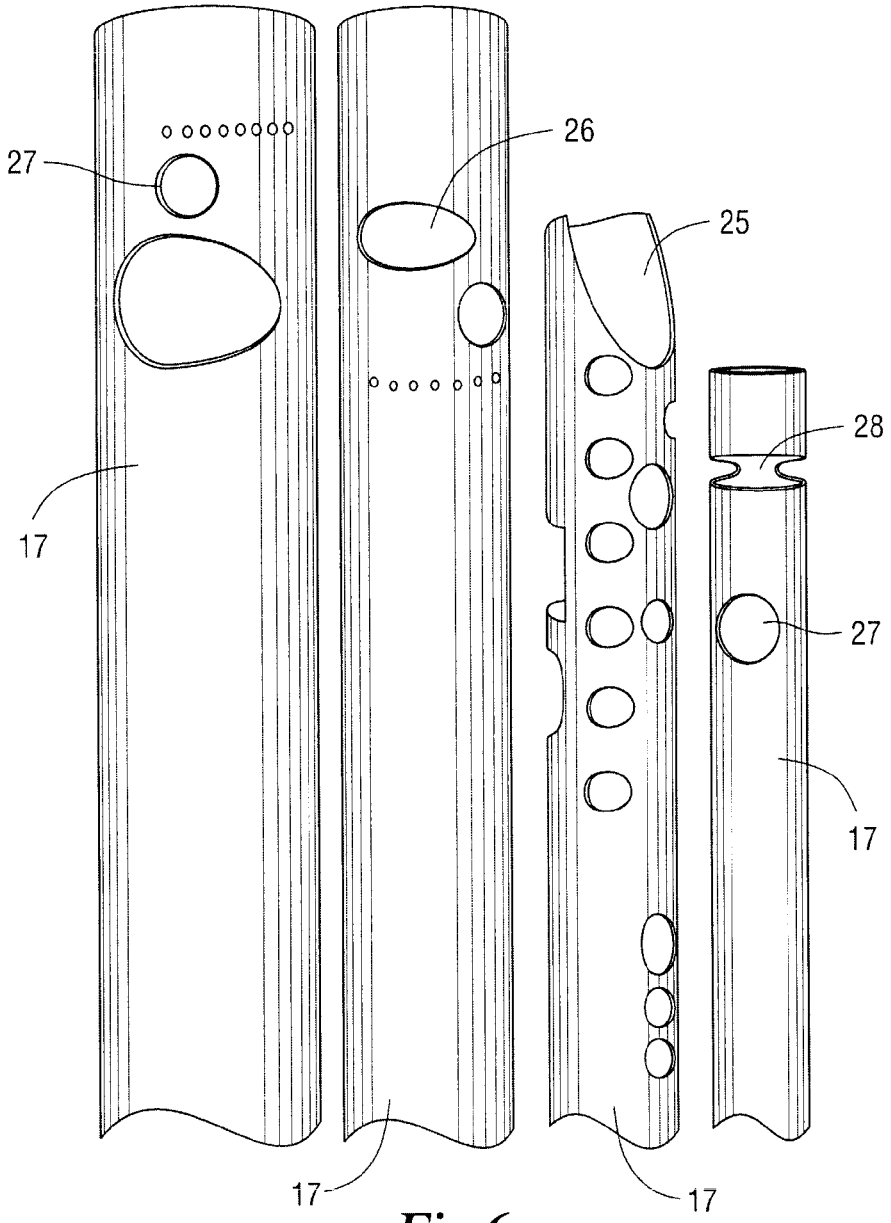
FIG. 6 shows four examples of the round or spiral ducts that have been cut on the round duct and round spiral duct cutting machine for the mating attaching structures such as branches and registers.
Figure 7A:
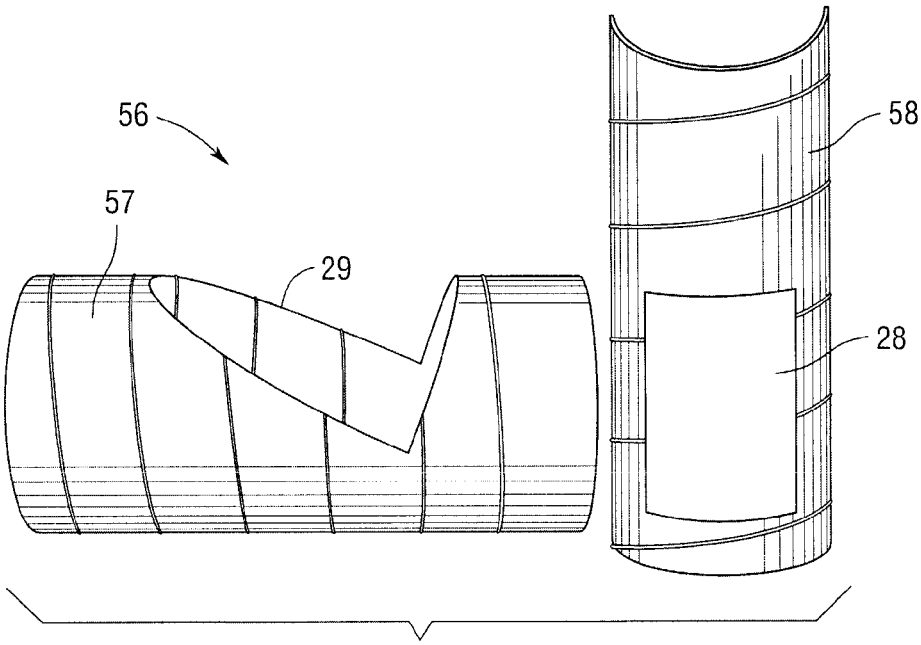
FIG. 7A illustrates the cut duct parts to make a tap.
Figure 7B:
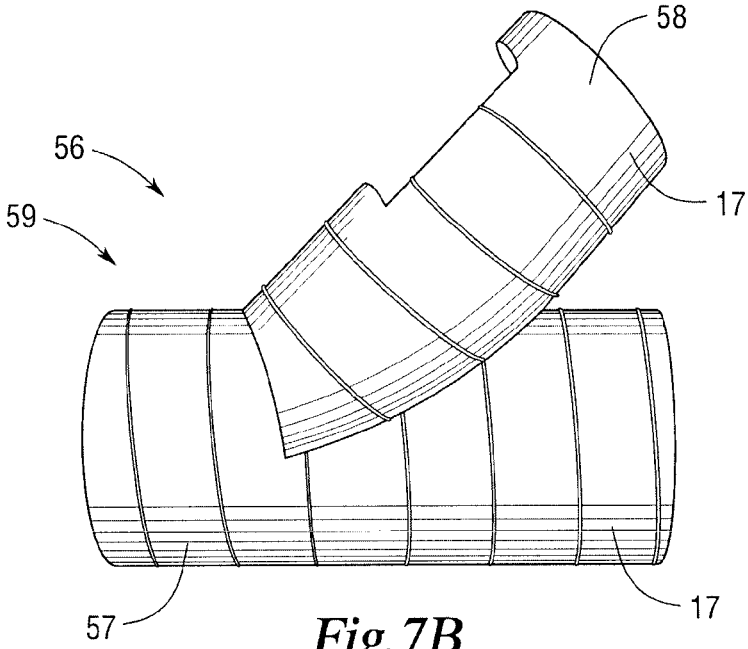
FIG. 7B illustrates the parts assembled to make a tap.

This round duct and round spiral duct cutting machine 10 comprises a plurality of components including: an electronics cabinet 13 mounted in the cutting machine base 19, round duct and spiral duct support bed 20, multiple jaw chuck 11, rotary servomotor 12 and gear reducer 46, and the linear motion carriage 14 that carries the plasma cutting torch 16 that moves the torch 16 along the duct 17 over the linear rail 15 and the vertical motion carriage 44 that moves the plasma cutting torch 16 vertically along the vertical rail 46 maintaining the cutting torch 16 in close proximity to the duct 17 while the cuts are made. The round duct computer control 52 is able to cut holes 27, rectangles 28, and irregular shapes 25, 26 out of the round or spiral duct 17, as desired, as shown in FIG. 6.

Figure 1:
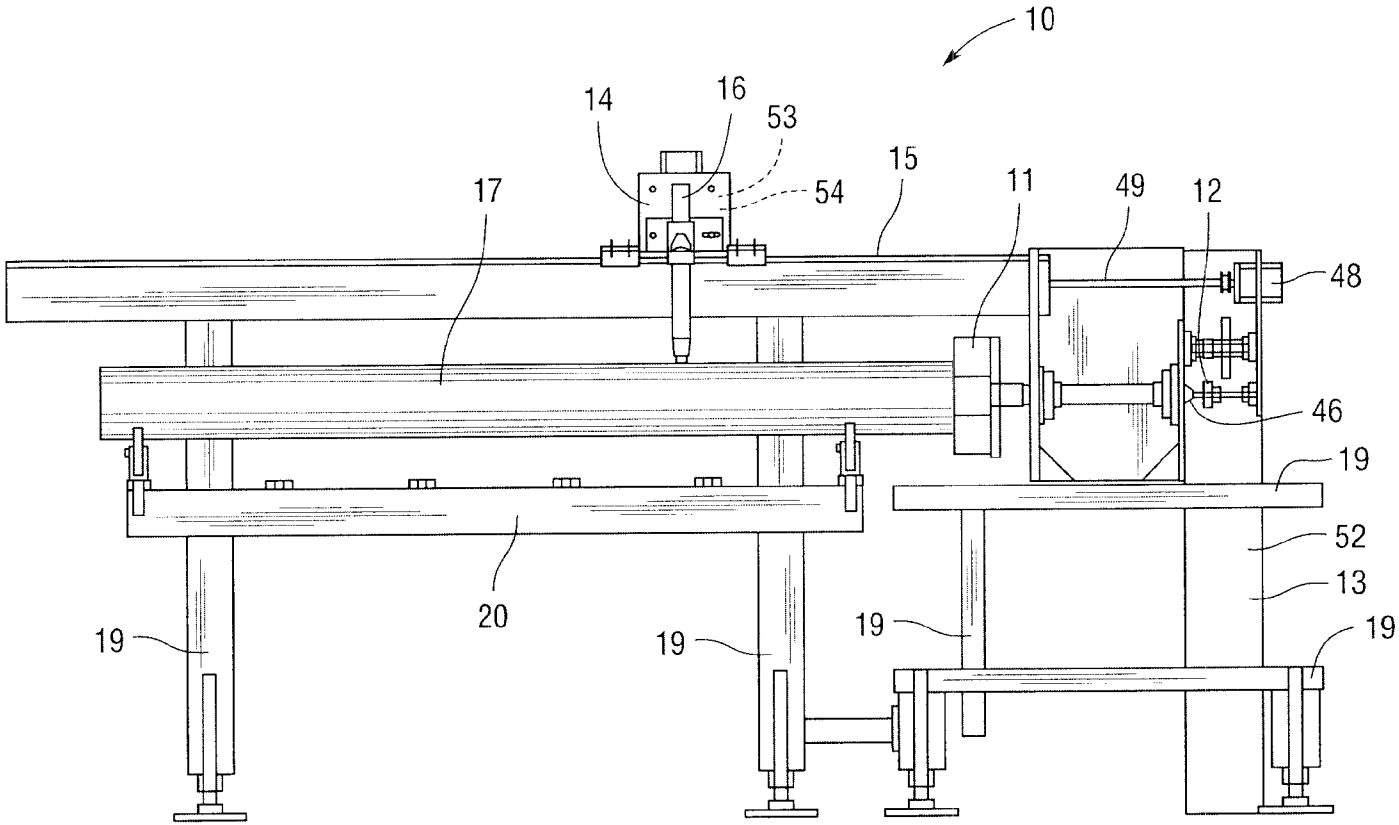
FIG. 1 is a side view of the cutting machine with round duct supported on the linear carriage and secured by the multiple jaw chuck ready to be processed by the plasma cutting torch.
Figure 1A:
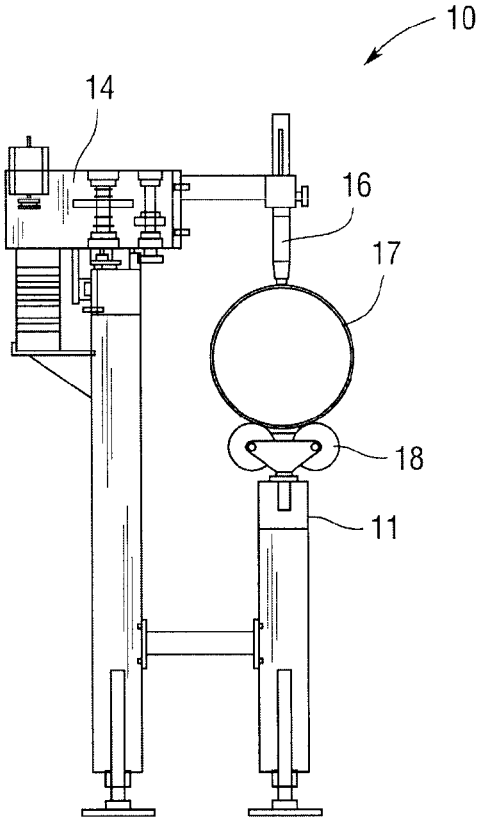
FIG. 1A is an end view showing the plasma torch in cutting position on a large diameter round duct member.
Figure 1B:
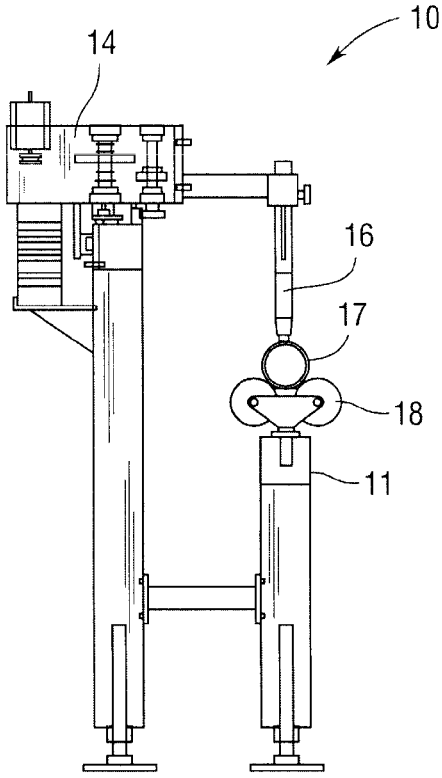
FIG. 1B is an end view showing the plasma torch in cutting position on a small diameter round duct member.
Figure 2:
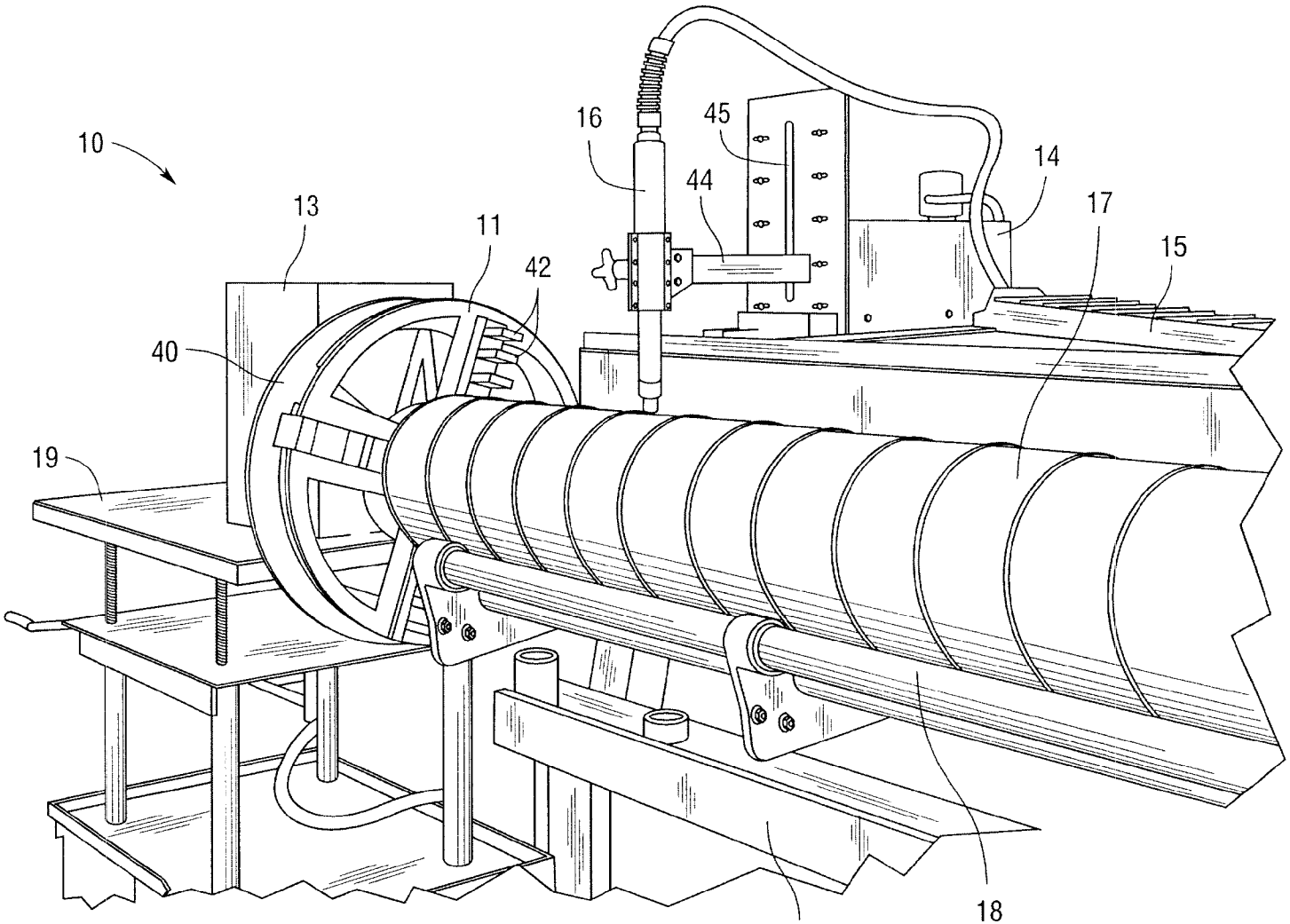
FIG. 2 is perspective side view of the round or spiral duct on the support bed and the linear motion carriage that carries the plasma cutting torch over the round or spiral duct to cut holes, rectangles, and irregular shapes onto the round duct and round spiral duct.

The exemplary round duct and round spiral duct cutting machine 10 includes as shown in FIG. 2 a machine base frame 19 that has the ability to raise and lower the multiple jaw chuck 11 that positively grips the round or round spiral ducts 17, seen in FIG. 1, that can range between 4 inches to 60 inches in diameter.

Figure 3B:
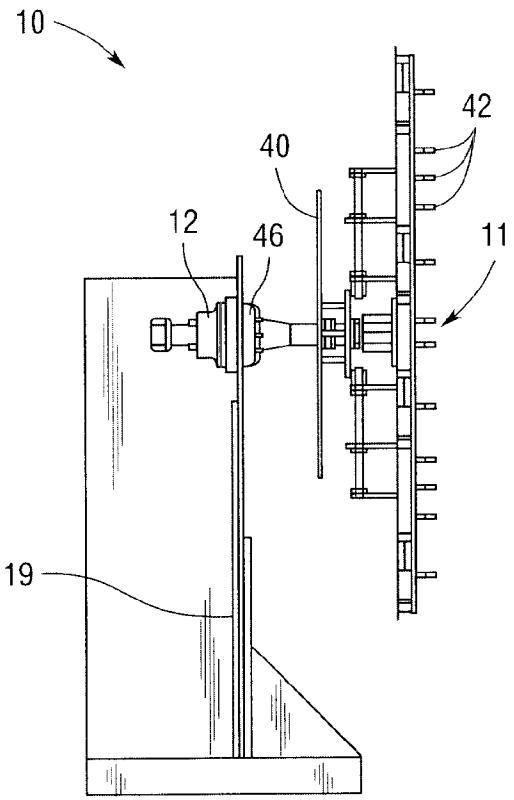
FIG. 3B is a side view of the end of the cutting machine showing the multiple jaw chuck, and the engaging fingers, the hand wheel, the rotary servomotor, reducer, and the electronics panel in the machine base.
Figure 3A:
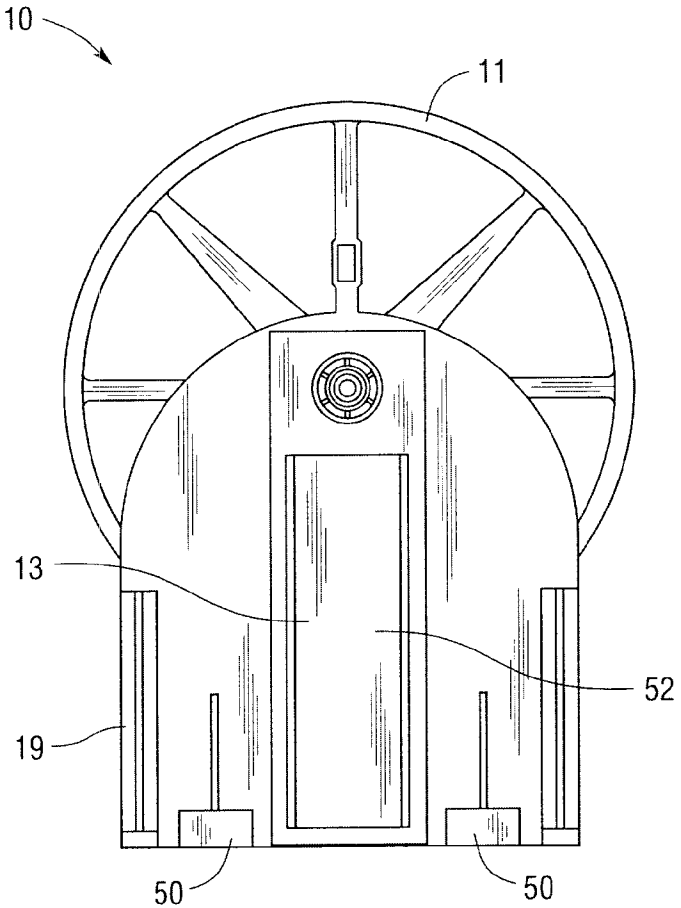
FIG. 3A is an end view of the cutting machine showing the multiple jaw chuck, rotary servomotor, reducer, and the electronics panel mounted 111 the machine vase.

As seen in FIG. 3 there are adjustable tubular rollers 18 to accommodate the large diameter range of the round and spiral ducts 17.

The adjustable tubular rollers 18 ride on antifriction bearing rails 21 that are mounted to the support frame 20 that allow adjustable tubular rollers 18 to be positioned in or out so that 4 inches to 60 inches diameter round and spiral ducts 17 can be supported.

It is important to support the spiral duct along its entire length because the spiral duct is helically wrapped and continuously joined to itself by a roll-formed seam along the helical seam. It is necessary to support the spiral duct over its entire length to accurately maintain the spiral duct in position during the cutting operations.

The plasma torch 16 is positioned at a proper cutting gap distance in relation to the round or round spiral duct 17.

As seen in FIG. 2 the electronics panel 13 receives commands from the computer control 52 to control all mechanical and electrical functions.

Circular interpolation simultaneously rotates the multiple jaw chuck 11 bi-directionally clockwise and counterclockwise, by the coupled servomotor 12 and gear reducer 46 that grips the round or round spiral ducts 17, seen in FIG. 1.

While moving the linear motion carriage 14 bi-directionally back and forth along linear rail 15, by means of a second servo motor 48 and a screw 49 or other operatively connecting structure that is also controlled by electronic panel 13 to carry the plasma cutting torch 16 along the entire length of the linear rail 15 of the round duct and round spiral duct cutting machine 10, as seen in FIG. 1. Similarly, the vertical motion carriage 44 moves the plasma torch 16 bi-directionally up and down along the vertical rail 45 by means of a third servo motor 53 and a screw 54 or other suitable operatively connecting structure that is also controlled by electronic panel 13.

Figure 5:
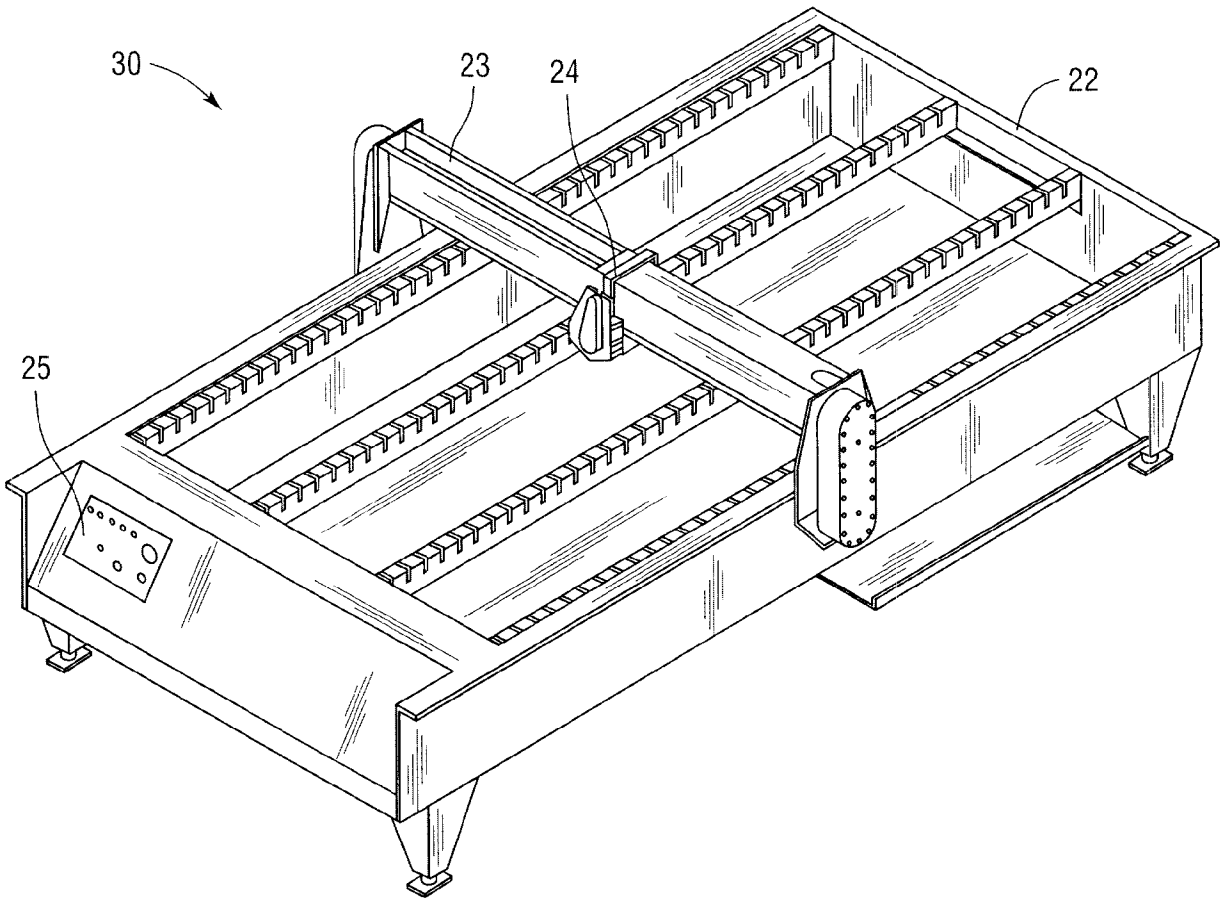
FIG. 5 is an illustration of the isometric view of a computer controlled X and Y plasma-cutting machine that cuts the attaching structures.

With this structure, it is possible to cut round holes 27, rectangles 28, and first irregular shapes 25 and second irregular shapes 26, as desired, onto the round duct and spiral ducts shown in FIG. 5.

A brief description of the multiple jaw chuck 11 and the hand wheel 40 as shown in FIG. 2 is described next.

The multiple jaw chuck 11 is a machined unit that has fingers 42 that are spaced every 1 inch apart.

The multiple jaw chuck 11 is adjusted manually by the machine operator by turning the hand wheel 40 to adjust the multiple jaw chuck 11 to tightly grip the round or round spiral duct 17, seen in FIG. 1.

There is very minimal turning of the hand wheel 40 because the multiple jaw chuck 11 fingers 42 are closely spaced every 1 inch apart.

In FIG. 5 the X and Y plasma cutting machine 30 cuts the attaching structures that were programmed in the round duct and round spiral duct cutting machine software program.

The X and Y plasma cutting machine 30 is presently used to cut round and rectangular Heating, Ventilation, and Air Conditioning fittings, such as elbows, offsets, and transitions.

The X and Y plasma-cutting machine 30 is used for cutting HVAC fittings.

The X and Y plasma-cutting machine 30 includes the cutting table 22 that supports the material to be cut, a gantry 23 that traverses the X-axis and a carriage 24 that holds the plasma torch and traverses the Y-axis simultaneously through circular interpolation via the machine electronics 13 that are computer controlled to cut HVAC fittings and the attaching structures of the round duct and round spiral ducts.

Figure 8:
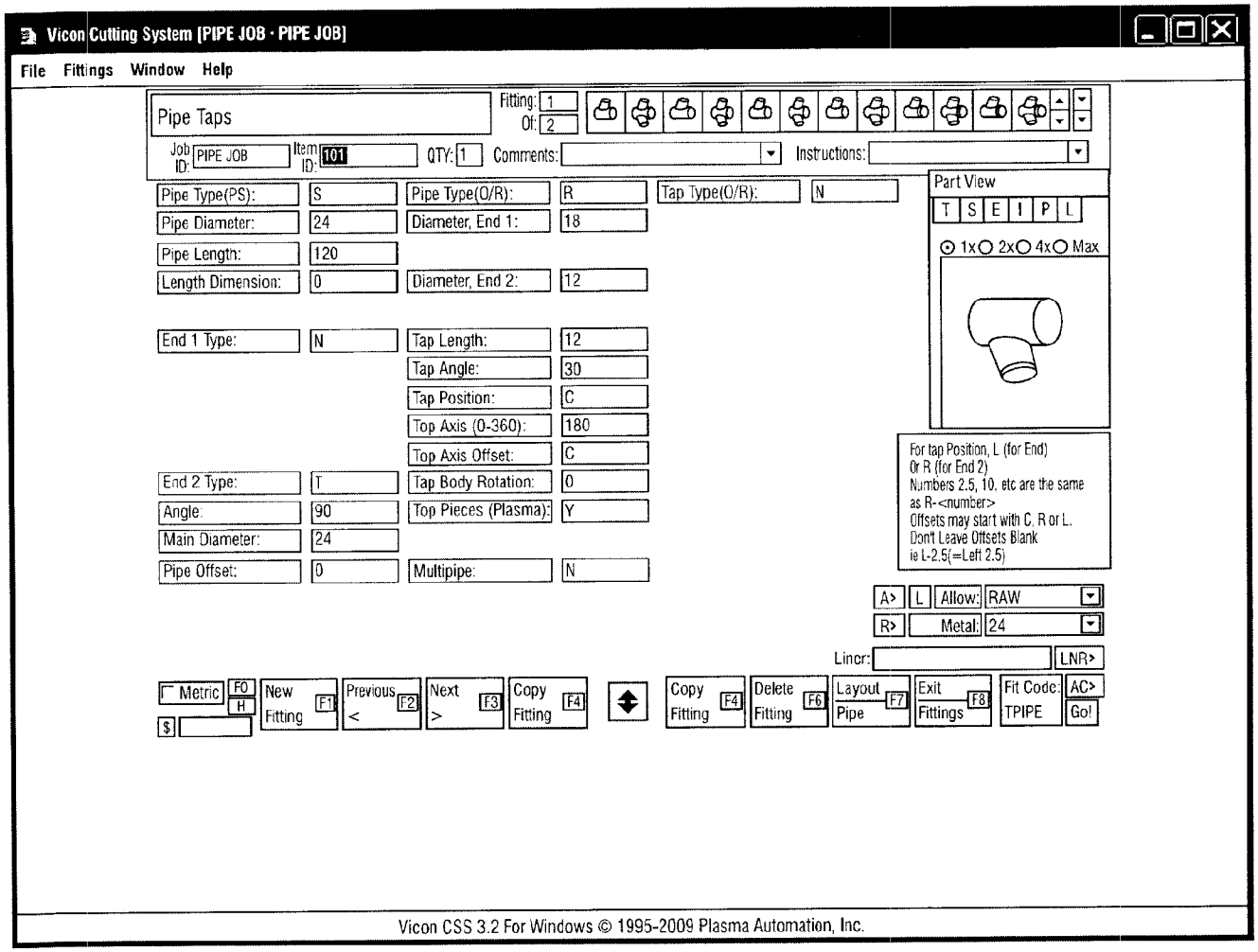
FIG. 8 is a screen shot of the computer program description entry screen for programming of the round or spiral ducts with attaching structures. The program can produce cutouts such as holes, cut outs, and other various shapes, and end treatments such as end trimming, miters, and tap connections to round duct and round spiral ducts. Allowances and notches can be added or subtracted on all cutouts and end treatments so that the attendant-attaching structures can be attached to the round duct and round spiral duct. The round and spiral duct is laid out in the flat for the round duct and spiral duct cutting machine, while the attaching structures patterns are laid out in the fiat for the X and Y cutting machine.
Figure 9:
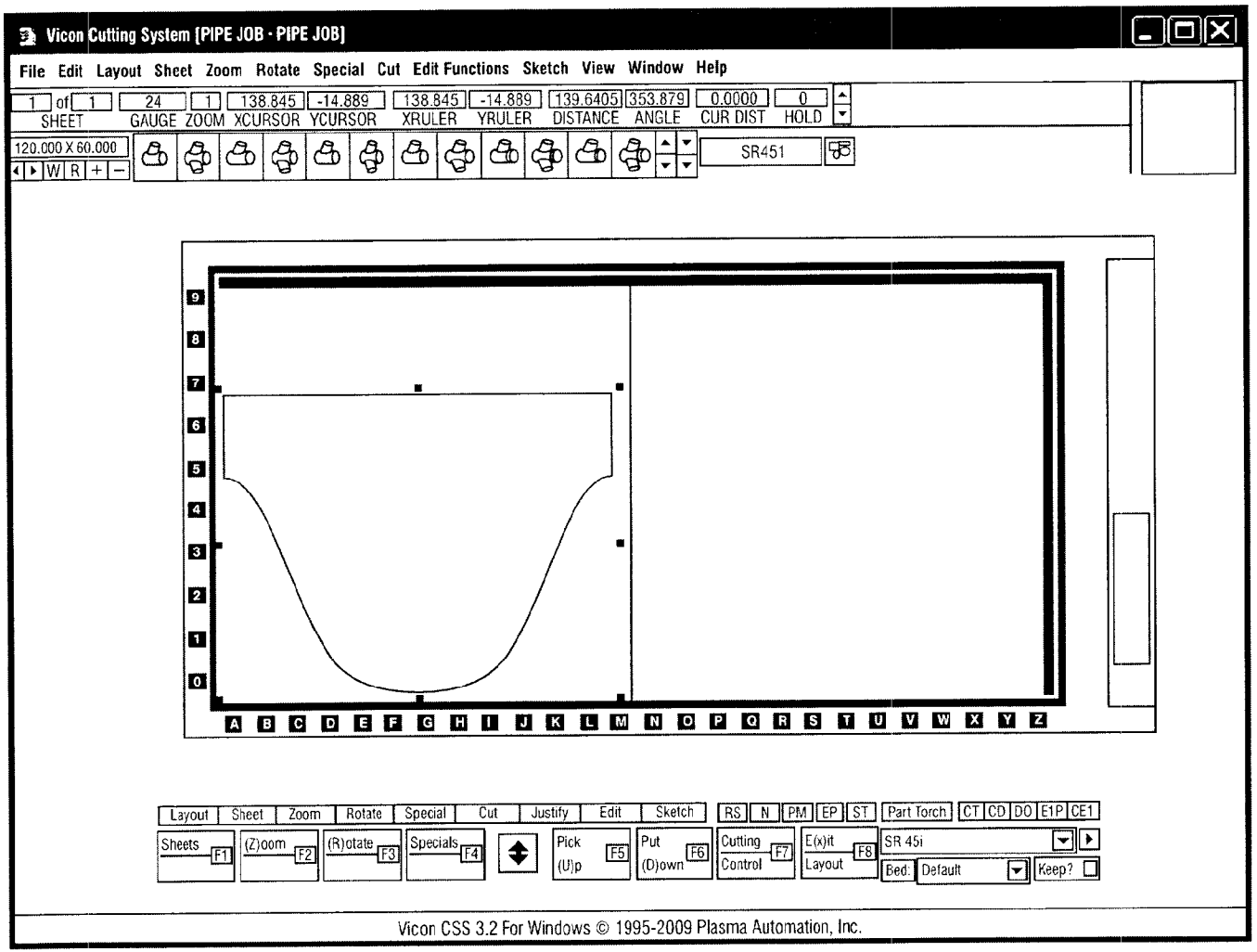
FIG. 9 is a screen shot of the computer program, human user interface (HUI) screen, showing for patterns that are laid out in the flat for the X and Y plasma-cutting machine, used for cutting the attaching structures.
Figure 10:
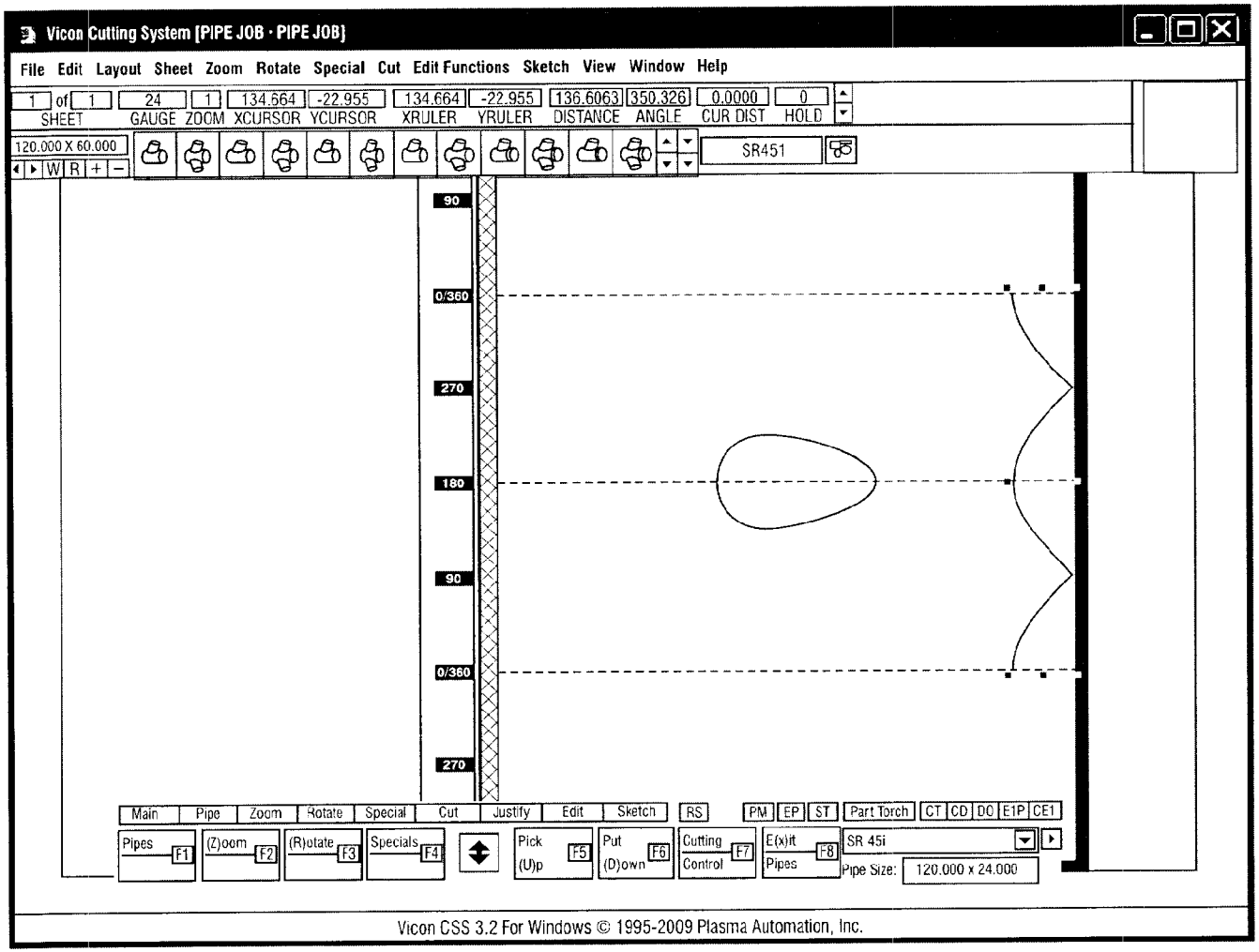
FIG. 10 is a screen shot of the computer program, human user interface (HUI) screen, showing patterns that are laid out in the flat so that all entities can be viewed at once by the person looking at the screen. In addition to viewing the entities, other entities can be accurately added using either X and Y or linear and angular coordinates. Finally the round duct and spiral ducts are then cut at the round duct and spiral duct cutting machine by use of this screen.

The round duct and round spiral duct cutting machine's software program has details seen in FIG. 8, FIG. 9, and FIG. 10.

This round duct and round spiral duct cutting machine's software program comprises a plurality of components including: an entry screen 60 as shown in FIG. 8, an optional X and Y plasma machine layout screen as shown in FIG. 9, and a round duct and round spiral duct cutting machine's layout screen as shown in FIG. 10.

As shown in FIG. 8 entries are made that describe the complete description of the spiral duct with the attaching structures locations and sizes.

The entries can be entered at the machine or at another computer that may be networked to the machine computer.

A person enters the entries of the complete description of the spiral duct with holes, rectangles, irregular shapes, and attaching structures with the aid of a three dimensional view.

The program can produce cutouts such as holes, rectangles, and other various shapes, and end treatments such as end trimming, miters, and tap connections to round duct and spiral ducts.

The software that generates the patterns and shapes also has the ability to add allowances that add or reduce the shape and pattern sizes for allowing connections either to or from other round and spiral duct or items.

The allowances also have the capability to produce notches of various shapes and angles to the patterns and shapes that are generated by the computer software to allow for easier forming of the resized shapes and patterns leading to the ability of making those connections for the mating round and spiral duct or items.

Allowances and notches can be added or subtracted on all cutouts and end treatments so that the attendant-attaching structures can be attached to the round duct and spiral duct.

This program of the computer-controlled machine modifies the round and spiral ducts that require secondary work to be preformed to them. One example is that registers that mount to the pipe need to be cut in and mounted. Another example, the main trunk round and spiral ducts may need cutouts in them for branches that run outwardly from them. Yet another example is cutting down short lengths from a longer length and yet another example is cutting tap-in or mitering the ends of a round and spiral duct so they can connect to a main trunk round and spiral duct.

This program of the computer-controlled machine also has the ability to avoid the seams of the spiral ducts, when cutouts that span across the seams are cut into the spiral ducts. The computer program calculates the position and width of the seams and avoids cutting across the seams by segmenting the cutouts into multiple paths, thus creating multiple holes or cutouts that are sized the same at the outer perimeter of the normally single cutout that is needed for the attaching structures. Leaving the seams uncut helps keep the integral strength of the spiral duct intact.

The round and spiral duct is laid out in the flat for the round duct and spiral duct cutting machine while the attaching structures patterns are laid out in the flat for the X and Y cutting machine.

After completing the entries of the first duct another duct can be selected so that the next duct can be described.

After the second duct is described, another can be selected and described, this is repeated for the different quantities of ducts that are needed.

As the ducts are being described in a three dimensional view, the program lays out the three dimensional spiral duct and attaching structures in the flat at the corresponding machine layout screen as shown in FIGS. 9 and 10.

Labels with or without a bar code are then printed for a spiral duct list that are to be manufactured at the round spiral duct-forming machine.

Labels with or without a bar code can also be printed for the attaching structures to be manufactured at the X and Y plasma-cutting machine 30.

The entries of the complete description of the spiral ducts with holes 27, rectangles 28, irregular shapes 25, 26, and attaching structures are then considered a job and are then saved as a computer file in the computer program.

Using the instructions printed on the labels or plain paper that was printed from the computer program, the round or spiral duct is then manufactured or pulled from inventory.

Figure 4:
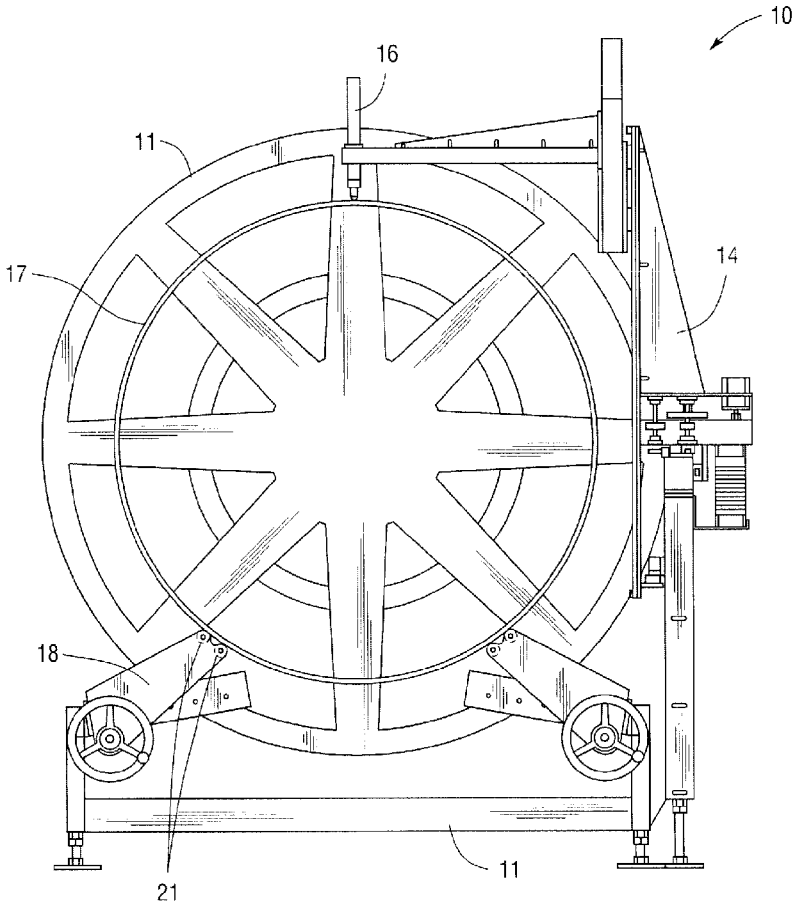
FIG. 4 is an end view showing a round duct supported in the tubular rollers, the hand wheels that quickly adjust to the size of the duct being supported, and the plasma cutting torch in cutting position.

Meanwhile if applicable the attaching structures are pulled from inventory or manufactured at the computer controlled X and Y plasma-cutting machine 30, see FIG. 4, which had previously received the machine code language that was created by the computer program.

An optional bar code scanner may be used to call the corresponding computer program file to open at the computer controlled X and Y plasma-cutting machine 30, see FIG. 8.

Once the round or spiral duct is manufactured or pulled from inventory it is then placed on the round duct and round spiral duct cutting machines 10 adjustable tubular rollers 18, see FIG. 1.

An optional bar code scanner may be used to call the corresponding computer program file to open at the round duct and round spiral duct cutting machine 10, see FIG. 1 and FIG. 10.

If the optional bar code scanner is not used, the operator simply opens the corresponding computer program file, see FIG. 10, by the name listed on the printed label or plain paper description that was printed from the computer program.

Once the corresponding computer program file is opened at the round duct and round spiral duct cutting machine 10, the operator commands the round duct and round spiral duct cutting machine 10 to cut the round duct and round spiral duct 17 that had been placed on the adjustable tubular rollers 18 and locked into the multiple jaw chuck 11, see FIG. 1, thus completing the manufacture of the round duct and spiral duct with holes 27, rectangles 28, and irregular shapes 25, 26 that were cut into the round duct and round spiral duct 17.

I claim:

1. An apparatus to cut holes, rectangles, and irregular shapes into round duct and spiral duct and attaching structures, the apparatus comprising:

a machine having an electronics cabinet mounted in a machine base, a round duct and spiral duct support bed, a multiple jaw chuck, a rotary servomotor and a gear reducer that turns the round and spiral duct as the cuts are made, a linear motion carriage that carries a plasma cutting torch over the round duct and spiral duct, and a computer control, operatively connected to cut holes, rectangles, and irregular shapes into the round duct;

the computer controls all mechanical and electrical functions to cut holes, rectangles and irregular shapes into the round duct;

a computer program used to describe the entries of the complete description of the spiral duct with holes, rectangles, irregular shapes, and attaching structures to be cut;

a three dimensional view;

secondary modification including end trim, miter, tap connection, holes, slots and shapes for branches and registers to attach;

wherein a work piece is supported on adjustable tubular rollers along substantially the entire length of the work piece; and wherein software has allowances to produce notches of various shapes and angles to the patterns and shapes that are generated by the computer software for easier forming of the resized shapes and patterns leading to making those connections for mating round or spiral duct and attendant-attaching structure.

2. The apparatus of claim 1, wherein said work piece is moved bi-directionally and a plasma torch or cutting device is moved bi-directionally using circular interpolation to make the required cuts.

3. The apparatus of claim 1, wherein the plasma torch or cutting device is positioned near a work piece and is operatively connected to a mechanism that moves the torch or cutting device back and forth along the length of the work piece.

4. The apparatus of claim 1, wherein a work piece is turned clockwise and counterclockwise while being supported on adjustable tubular rollers.

5. The apparatus of claim 1, wherein a work piece is turned clockwise and counterclockwise while being supported on adjustable tubular rollers while the torch or cutting device moves back and forth along the length of the work piece simultaneously using circular interpolation to modify round and spiral duct.

6. The apparatus of claim 1, wherein the computer program describes the entries of ducts and taps that are needed to connect to the round and spiral duct to be modified; said entries being sent to a computer controlled X and Y flat type cutting machine that then cuts those mating patterns of the mating pieces or ducts.

7. The apparatus of claim 1, wherein the computer program describes the entries of ducts and taps that are needed to connect to the round and spiral duct to be modified; said entries being cut on the round and spiral duct cutting machine for those attachments that are to be round or spiral duct attachments.

8. A software driven round duct cutting machine having a base and a multi jaw reel style chuck, a plasma torch or cutting device mounted near or above the base, the plasma torch or cutting device is moved in a linear bi-directional motion at the same time a work piece is rotated bi-directionally, the work piece is supported along substantially the entire length of the work piece, said software is capable of modifying round and spiral duct for the heating, ventilation and air conditioning industries, and said machine displays the round and spiral ducts in the flat so that modifications of cutouts, holes, slots, and end treatments can all be viewed at the same time;

wherein said software modifies round and spiral duct for the heating, ventilation and air conditioning industries;

wherein said machine displays the round and spiral ducts in the flat so that modifications of cutouts, holes, slots, and end treatments are viewed at the same time;

wherein said software that displays the round and spiral ducts in the flat so that modifications such as cutouts, holes, slots, and end treatments are added and modified using either X and Y coordinates or angular and linear coordinates;

wherein said software reduces or enlarges the cutouts holes, slots, and end treatments by use of allowances so that attendant-attaching structures attach to the cutouts holes slots and end treatments;

wherein software has allowances to produce notches of various shapes and angles to the patterns and shapes that are generated by the computer software for easier forming of the resized shapes and patterns leading to making those connections for mating round or spiral duct and attendant-attaching structures;

wherein said software avoids the seams of the spiral ducts, when cutouts that span across the seams are cut into the spiral ducts;

wherein said software calculates the position and width of seams and avoids cutting across the seams by segmenting the cutouts into multiple paths, thus creating multiple holes or cutouts that are sized the same as the outer perimeter of a single cutout that is normally needed for the attaching structures wherein said software leaves seams uncut whereby the integral strength of the spiral duct remains intact;

wherein said software generates attaching structures that are then cut on an X and Y flat cutting machine; and wherein said software controls both the round and spiral duct cutting and trimming machine, and an X and Y flat cutting machine;

said software utilizes a bar scanner, so that matching geometry to spiral duct is accomplished;

said software utilizes a labels bar code, so that matching geometry to spiral duct is accomplished; and, said software utilizes a labels job and item identification, so that matching geometry to spiral duct is accomplished.

* * * * *